US006772847B2

(12) United States Patent
Rae et al.

(10) Patent No.: US 6,772,847 B2
(45) Date of Patent: Aug. 10, 2004

(54) CHEMICALLY ENHANCED DRILLING METHODS

(75) Inventors: Philip J. Rae, Singapore (SG); Gino F. Di Lullo Arias, Rio de Janeiro (BR); Lance N. Portman, Jakarta (ID)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 10/082,890

(22) Filed: Feb. 26, 2002

(65) Prior Publication Data

US 2003/0164252 A1 Sep. 4, 2003

(51) Int. Cl.[7] ..... E21B 7/04; E21B 7/18

(52) U.S. Cl. ..... 175/62; 175/19; 175/64; 175/66; 507/145; 507/103

(58) Field of Search ..... 175/19, 21, 61, 175/62, 64, 67, 424, 66; 299/5, 17; 405/58; 507/145, 103

(56) References Cited

U.S. PATENT DOCUMENTS 2,258,001 A * 10/1941 Chamberlain ..... 175/40
2,271,005 A * 1/1942 Grebe ..... 175/61
4,431,069 A * 2/1984 Dickinson et al. ..... 175/61
5,246,273 A * 9/1993 Rosar ..... 299/4
5,740,873 A * 4/1998 Tibbitts ..... 175/393
5,771,984 A * 6/1998 Potter et al. ..... 175/14
6,152,356 A * 11/2000 Minden ..... 299/17
6,164,727 A * 12/2000 Kelly ..... 299/4
6,347,675 B1 * 2/2002 Kolle ..... 175/69
2003/0121701 A1 * 7/2003 Polizzotti et al. ..... 175/17

OTHER PUBLICATIONS

Phil Rae and Gino Di Lullo, "Chemically–Enhanced Drilling With Coiled Tubing In Carbonate Reservoirs", 2001 SPE/ADC Drilling Conference, Amsterdam, The Netherlands, Feb. 27–Mar. 1, 2001, 10 pages.

* cited by examiner

*Primary Examiner*—George Suchfield
(74) *Attorney, Agent, or Firm*—Howrey Simon Arnold & White LLP

(57) ABSTRACT

Methods and materials for chemically enhanced drilling of oil/gas wells are disclosed. The use of drilling fluids containing chemicals that dissolve formation constituents results in the creation of boreholes. Fluids containing acids such as hydrochloric acid, formic acid, acetic acid, or combinations thereof have been found to be especially useful in chemical drilling of formations containing basic minerals such as calcium carbonate. The use of acid has the further advantage of simultaneously stimulating the borehole.

36 Claims, 3 Drawing Sheets

CHEMICALLY ENHANCED DRILLING METHODS

FIELD OF THE INVENTION

The invention relates to drilling methods useful in the oil and gas industry. In particular, materials and methods for chemically enhanced drilling are disclosed.

BACKGROUND OF THE INVENTION

Both drilling and/or jetting holes in rock are practiced in several industries, including the oil and gas industry as well as the underground pipe and cable laying industry. Drilling is normally accomplished by the use of rotary or percussion bits, aided by fluid jets designed to sweep the cut rock away from the cutters. In some instances the power of the jets may also be used to enhance the cutting efficiency of the bit. Drilling specifically by jetting is normally accomplished by using high velocity jets, usually with water, to mechanically erode the surface of the rock. Such jetting drilling is typically limited to softer, weaker formations, normally found at shallower depths.

Stimulation of a drilled well is often required. Acid is commonly used in the oil and gas industry to stimulate wells and to increase the production rate of the treated wells. The acid works in at least one of four ways: (1) by increasing the permeability of the rock around the well bore; (2) by creating wormholes extending out from the well bore (small random tunnels created in the formation); (3) by removing matter introduced into the formation by the drilling process such as polymers or particles of calcium carbonate; and (4) by fracturing the formation and then dissolving material away from the fracture to create production planes so that a high conductivity site is created.

The use of continuous reeled tubing ("coiled tubing") has been limited to a small percentage of wells due to its high equipment and personnel costs, low rates of penetration, and issues related to the reliability of high-cost "smart" bottom hole assemblies needed for directional drilling. This is despite significant improvements in the quality and dimensions of coiled tubing itself—pipe sizes have increased from 1 inch OD to 3.5 inch OD and greater.

Conventional drilling and jetting methods have several significant shortcomings. The drilling methods produce large amounts of rock cuttings which must be brought to the surface in order to create the well. The transport of the cuttings requires the use of special drilling fluids capable of suspending the cuttings. Handling equipment is required at the site surface to handle, store, and dispose of the cuttings. The drilling fluids are often separated from the cuttings and recycled, all of which requires considerable effort, time, and expense. Conventional drilling machinery is mechanically complicated, expensive, and contains multiple parts that may be subject to failure or wear.

Thus, there exists a need for improved drilling methods that are effective and maximize production while minimizing expense.

SUMMARY OF THE INVENTION

Acids and other chemicals have been used to increase the permability of the rock remaining around a main borehole constructed by mechanical means. These chemicals have not been used as the primary method of constructing the well bore. This is despite a multitude of ideas been tried using different rotary devices, percussion devices and mechanical jetting devices.

Hole construction using a dissolving fluid alone, or a dissolving fluid with conventional mechanical methods does not fit well with conventional drilling practices and equipment. Conventional drilling practices require that the wellbore constructed be "sealed" as it is drilled to maintain "control" of the hole. The chemically enhanced drilling method described herein does not provide for this. Also, conventional drilling rigs are not well suited to handling corrosive fluids. Hence chemically enhanced drilling methods have not been previously developed.

Several changes in the industry are the growing acceptance of underbalanced drilling as a method of constructing holes without "sealing" them, and the growing acceptance of using coiled tubing to drill holes. Continuous reeled tubing ("coiled tubing") operations are ideally suited to using corrosive fluids. There now exists methodology and apparatus to permit an old method of pumping acid to be used for the new application of creating wellbores.

DESCRIPTION OF THE FIGURES

The following figures form part of the present specification and are included to further demonstrate certain aspects of the present invention. The invention may be better understood by reference to one or more of these figures in combination with the detailed description of specific embodiments presented herein.

| FIG. | Description |
|---|---|
| 1 | Example assembly designed to build angle used to skirt the top of a soluble formation when a less soluble formation exists above |
| 2 | Example assembly designed to drop angle used to skirt the bottom of a soluble formation when a less soluble formation exists below |
| 3 | Swirl inducer upstream of a nozzle can result in a conical jet pattern giving full coverage of the borehole face |
| 4 | Conical nozzle with straight-through-center nozzle |
| 5 | Many individual nozzles can be used to cover entire borehole |
| 6 | Example of a non-round "clover leaf" borehole produced by the inventive methods using a four nozzle jetting assembly |

DETAILED DESCRIPTION OF THE INVENTION

Figure 1:
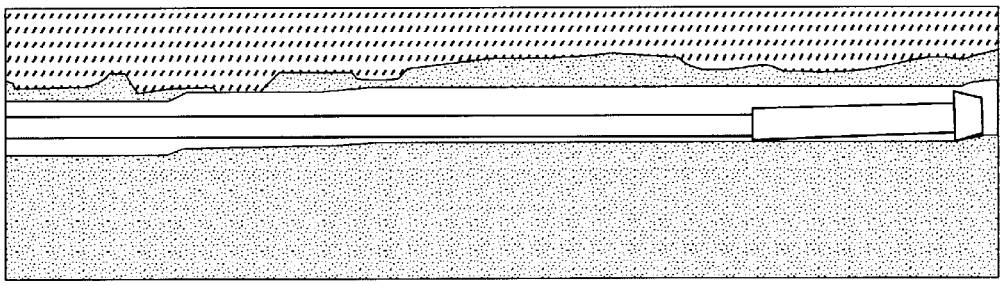

Methods are disclosed herein for the use of chemicals in oil and/or gas (oil/gas) well drilling. The new method includes creating a primary well bore itself by dissolving rock, or significant constituents of a formation, with chemicals (such as acids), preferably in a controlled manner. The well bore so created might form a long, small diameter hole, or multiple short, lateral drainage channels originating in a main borehole and extending outward radially through the reservoir, at one or several depths. However, any hole, including a main borehole itself, could be created using this technique. In addition, a stimulated borehole might be produced by the system. The chemicals can be any chemical that dissolves rock at a rate sufficient for production of the well bore. An example of such a chemical is an acid, such as hydrochloric acid, acetic acid, formic acid, nitric acid, hydrofluoric acid, and mixtures thereof. The chemical can alternatively be a non-acid chemical such as $Na_4EDTA$ (ethylenediaminetetraacetic acid, sodium salt). This invention was at least in part disclosed in SPE/IADC 67830 entitled "Chemically-Enhanced Drilling With Coiled Tubing in Carbonate Reservoirs" prepared for presentation at the SPE/IADC Drilling Conference held in Amsterdam, The Netherlands, 27 Feb.–1 Mar. 2001.

Carbonate formations constitute 30–35 percent of the world's petroleum reservoirs. The solubility of calcium carbonate in acid is usually in excess of 95 percent, and sometimes as high as 99.5 percent. The reaction products are benign, namely calcium chloride and/or magnesium chloride, carbon dioxide, and water. The chemical reaction of hydrochloric acid and calcium carbonate proceeds according to the following stoichiometry:

$$CaCO_3+2HCl \rightarrow CaCl_2+CO_2+H_2O$$

This method and apparatus for its implementation can be distinguished from using acid as a "stimulative" agent for enhancing erosion mechanisms, with regard to existing boreholes and/or from using acid in an acid wash, as currently practiced using high velocity jets. The instant invention creates boreholes, and in addition it can also "stimulate" the borehole. Jets are sufficient to ensure that a constant supply of fresh, reactive acid reaches intended reaction sites, without resort to high pressure drop systems. The instant invention can involve the use of high velocity jets or low velocity jets.

The instant system can be used for creating straight or curved holes. The shape of the hole may depend on the geometry chosen for the acid head and associated tooling. A system could be set up to build, hold or drop angle in a vertical plane with no control of azimuth. A system could also be set up with full directional control of both inclination and azimuth, including implementing a variety of different methods to supply an operator with information as to which way a hole is heading. The system could be used to construct one main well bore or a plurality of laterals extending away from a main bore. In particular, the system could be used to initiate a new hole extending out from a parent well bore. The parent well bore can be prepared using the instant invention, or can be prepared using conventional drilling methods.

There are many advantages of chemical drilling (drilling by dissolving) as compared to conventional mechanical drilling. These advantages include:

- achieving high construction rates in appropriate reservoirs by merit of the near-instantaneous reaction rate between acid and carbonate;
- creation of a hole with little or no solid debris being left in the well;
- not requiring the use of extensive settling tanks or other solids handling equipment upon the return of drilling liquid;
- reducing well bore damage and the avoidance of well sticking problems due to the absence of cuttings beds and solid debris in deviated holes;
- producing "stimulated" (at least to some extent) well bores;
- saving time by the lack of requirements to pull out of hole to change bits;
- minimizing pipe fatigue by eliminating the need to clear cuttings periodically by pulling the pipe out of the hole and running it back in; and
- reducing required handling equipment, including returns handling systems.

The dissolution of rock as opposed to the creation of cuttings offers several significant advantages. Dissolving rock as opposed to creating cuttings means that there is no requirement to bring cuttings back to the surface. This eliminates a requirement for specialized drilling fluids capable of suspending drill cuttings and for sustaining high fluid velocities in the return annulus in order to transport solids. Solids handling equipment is no longer required on the surface. There are environmental advantages associated with avoiding returning drill cuttings to the surface.

Because no cuttings are generated, no per se need exists for any fluid returns to be transported to the surface at all. Such freedom offers an opportunity to drill in sub hydrostatically pressurized formations without a need to plug the formation to stop leak-off. A well could be drilled with "lost returns" without danger of damaging a formation by solids migrating into the formation. This presents an alternative method to drilling formations underbalanced with lightweight drilling fluids. To the extent that chemical drilling or drilling by dissolving needs to be conducted with fluid returns to surface, with or without concurrent well production, chemical return handling equipment can be provided that is simpler than return handling equipment for fluid with cuttings.

A further advantage to reducing or eliminating the amount of cuttings generated is that less wear and fatigue will result on the drilling pipe and machinery. Coiled tubing is weakened by "wiper trips" to the surface, which would be reduced or eliminated by use of the instant invention.

Chemical drilling with returns may include the use of gas commingled with a drilling solution to lighten the hydrostatic head of the fluid system. If gas were used as part of a drilling fluid, the flexibility exists for the gas to be pumped continually commingled with the liquid, or alternately slugged, pumping gas stages and then liquid stages.

The system of the instant invention has the potential advantage to stimulate a drilled formation during drilling—"stimulation while drilling" ("SWD"). Leak off of dissolving fluid into a formation can result in increased permeability of the near well bore rock. A dissolving fluid may be tailored to produce higher or lower leak off rates of active solution, for example by viscosifying the fluid, or by gasifying or foaming the fluid. A careful choice of dissolving fluids can also result in deeper penetration of dissolving fluid away from a main well bore being constructed. Acid solutions can comprise one acid, or a mixture of two or more acids. One example of such a technique might be to use, for example, a mixture of hydrochloric acid and acetic acid, or a mixture of hydrochloric acid and formic acid for dissolving carbonate formations.

The system of the instant invention offers the further potential to create holes using smaller conduits, as little or no weight on the bit is required and lower circulating rates are permissible since hole cleaning is not an issue. The system offers the opportunity to pass through small diameter bores and then construct larger diameter boreholes, as a system can be constructed such that a chemical or acid reacts with rock constituents over a diameter significantly greater than the diameter of a jetting head.

A jetting system designed to dissolve a borehole can be mechanically simple, compared with conventional drilling alternatives, as discussed above. Simple tooling is usually less expensive to operate and can also afford the opportunity to construct holes turning at a tighter radius. Simple tool construction also permits tools to be constructed to smaller diameters than conventional drilling systems. This allows access into holes with tight restrictions through which the tools must pass, as well as permitting the tools to construct smaller diameter holes, if desired.

The system has particular application in highly acid-soluble formations such as calcite, dolomite, or mixtures of the two. In such highly soluble formations, the down hole tooling might comprise a simple nozzle (with or without steering capability). The system, of course, might also beneficially be used in conjunction with either a jet drill or a rotary or percussion bit as well as with orientation and/or navigation tooling. As discussed above, a hole might be constructed with or without fluid returns to surface, depending upon conditions.

The system could be used in partially soluble formations, for example, sandstones with concentrations of carbonate rock, or clays that can be dissolved. In partially soluble formations, the system would typically be used in conjunction with jet drills or rotary or percussion bits and would typically be operated with circulation of returns to the surface. In formations with large fractures, it might be possible to form holes using this method of chemical dissolution on a lost returns basis.

The system of the instant invention can include a jetting head, such as a low velocity head. The system can include a rotary bit with the jetting head. The rotary bit could be turned by a down hole rotary motor or by rotating pipe from the surface. Alternately the system can include a jetting head and a percussion bit. The percussion bit may require a percussion hammer above it.

Each of the tool combinations mentioned above could be operated with a system to give the assembly a tendency to build angle (turn up-hill), drop angle (turn down-hill) or hold angle (maintain constant inclination). Positioning centralizers and possibly weights and possibly utilizing flex joints or knucklejoints can be used in such systems. This first level directional capability does not typically allow for change of azimuth of the hole.

As a more complex alternative, each of the above tool combinations can be joined with additional means for giving a bottom hole assembly a tendency to turn up, down, left or right, or in any midway directions. Such control could be accomplished, for example, by:

(a) directing a jetting head preferentially away from an axis of a main well bore. The direction that the head is aimed could be controlled by rotating a jetting head. Rotating can be achieved by means such as a rotary tool down hole above a jetting head or by rotating a pipe from surface.

(b) using a reactive thrust of jets at the jetting head to push a jetting head away from a main well bore. The direction in which the head is pushed could be controlled by rotating a jetting head, by changing the pressure or flow distribution across jets by some internal mechanism, or by other means.

(c) preferentially sending more reactive fluid to one side of a jetting head. The direction in which a head deviates could be controlled by rotating a jetting head, by changing a reactive fluid distribution across jets by an internal mechanism, or by other means.

The above described assemblies could be used with or without a means for relaying the position and/or direction of the tool. Methods for achieving feedback of position relative to the earth include the use of magnetic sensors, gravity sensors, and gyroscopes. A sensor can be incorporated as part of a bottom hole assembly. In this instance, signals relating positional information could be relayed to the surface by several means, such as electrical cable, whirling telemetry, pressure pulse or "mud pulse" telemetry, electromagnetic telemetry, sonic telemetry, or fiber optics. Sensors could alternatively be run down to a bottom hole assembly periodically to survey a hole, not being a permanent feature of a jetting assembly.

Figure 2:
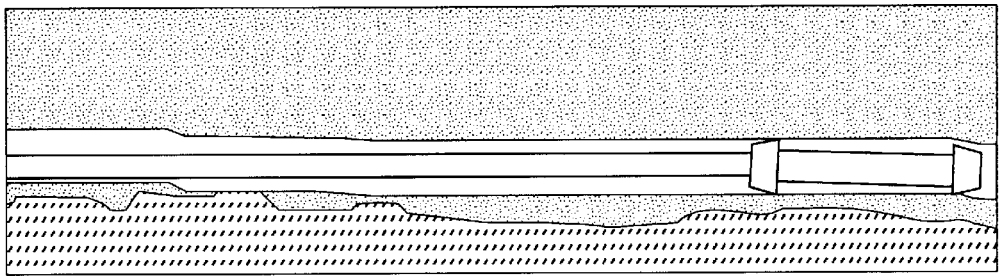

The system of the instant invention can be used to construct single boreholes, straight or curved, and vertical or deviated. The system can be used to construct lateral junctions, including one or more side laterals. The system can be used to follow a plane at which a higher soluble rock meets a lower soluble rock. Such system would tend to naturally stay in the higher soluble rock, which is generally where the hole is desirable. Examples of the use of this method include skimming across the top or the bottom of a producing zone (see FIGS. 1 and 2).

The system of the instant invention can be used to pump fluid through nozzles and down a pipe annulus simultaneously. Pumping down an annulus could prevent reactive fluids from returning up the well. For example, pumping gas, oil, water or neutralizing agents down an annulus can prevent reactive fluids from reaching equipment higher up the well bore. The system of the instant invention can be used in conjunction with other secondary flow paths, such as gas lift mandrels, in an existing completion.

Figure 3:
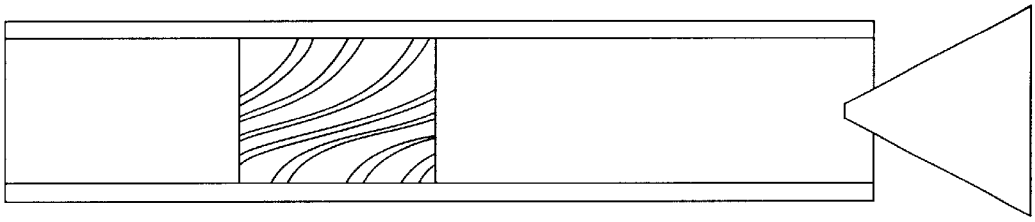
Figure 4:
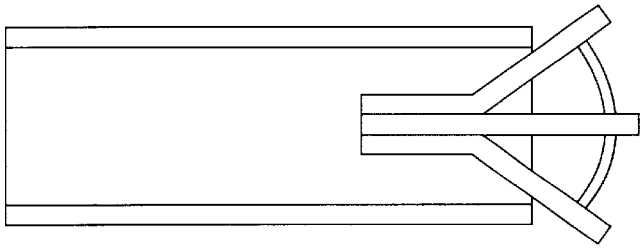
Figure 5:
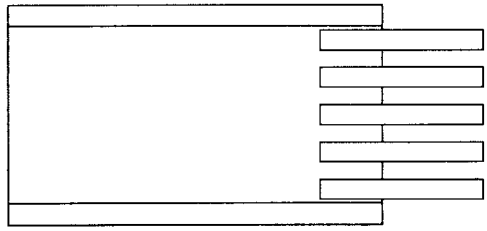

Different nozzle geometries can be used to achieve the goal of chemically dissolving or acidizing a formation (see FIGS. 3–5), with or without rotary or percussion drilling. Alternate embodiments include jets on the side of a nozzle housing, used to enlarge a bore of a hole drilled, and possibly to steer the direction of the new hole. Such side jets might also have plugs, designed to divert flow to where it is most needed.

Nozzles can be used where individual orifices are fitted with devices or plugs to stop flow if a "plug" can fully extend out from a nozzle housing. If a "plug" pushes against a rock, then more chemical would be delivered at that point.

The invention can be used in coiled tubing applications, and can also be used in other, more conventional drilling systems. The invention can be used in drilling multiple short, lateral drainage channels originating in a main borehole and extending outward radially through a reservoir, at one or several depths. However, any hole, including a main borehole itself, can be created using this technique and technology.

Current coiled tubing drilling operations are typically conducted using downhole motors (powered by mud circulation) connected to rotary drill bits. The instant invention could replace the motor and drill bit, in its simplest embodiment, with a jetting nozzle pumping acid through the nozzle(s) in such a way that the acid creates a hole by dissolving reservoir rock. As such, the technique can be used for operations in carbonate reservoirs (chalk/limestone/dolomite), but new acid systems under development (e.g. sandstone acid) may make it applicable in sandstone as well as other formations. Combining the use of acid and a drill-bit of suitable metallurgy can be used to enhance penetration rates in certain lithologies.

According to calculations, 1000 gallons of 15% hydrochloric acid can dissolve a 3 inch diameter tunnel 260 ft long in 20% porosity carbonate. The exact strength of the acid would need to be optimized for a specific lithology, as would a desired rate of penetration, realizable circulation/injection rate, corrosion rate on the tubing or CT interiors, etc. However, in using the instant invention it should be possible to achieve penetration rates in the order of hundreds of feet per hour, a figure that exceeds typical coil tubing unit (CTU) drilling rates. Not only can drilling by dissolving operate inherently faster than drilling by cutting, but faster controlled drilling rates should be possible since a steering package can be located closer to a dissolving nozzle than to a cutting or a jetting instrument. An ability to make large multilateral conduits at high speed, including in under balanced conditions, and perhaps while producing the well, with no drilling damage (and possibly even with automatic stimulation) offers significant advantages for completing a well in carbonate.

The technique may be further enhanced by the incorporation of gases. For example, mixing nitrogen gas ($N_2$) with the acid at injection, could provide gaseous expansion and among other things, higher exit velocities and could increase drilled-hole size and acid efficiency.

Full, controllable implementation of the technique of the instant invention in thin strata can include the use of fluid-pulse telemetry for measurement-while-drilling (MWD) and, perhaps, steering/orientation tools. However, for larger reservoirs where control may be less critical, jet nozzle orientation can be controlled by techniques such as the use of bent subs and/or pressure drop techniques. This could make a hole "steerable" by changing pump rates or acid velocity. Other variations can include the use of a tool with a nitrogen chamber and a balanced-piston arrangement controlling the orientation of different jets, and hence hole azimuth, by application of different pressures.

One embodiment of the invention is directed towards methods for drilling boreholes, the method comprising pumping a fluid through a pipe located in a downhole formation; jetting the fluid through at least one nozzle connected to the end of the pipe; and dissolving the formation constituent near the nozzle to produce a borehole; wherein the fluid comprises a chemical that dissolves the formation constituent. The downhole formation can generally be any downhole formation that comprises a formation constituent soluble in the fluid containing the chemical. The downhole formation can be a suspected or known oil or gas reservoir. Alternatively, the downhole formation can be above or adjacent to a suspected or known oil or gas reservoir. The inventive methods could be used in such a formation prior to the use of conventional drilling methods.

The method can further comprise progressively moving the nozzle into the borehole. As a result, the borehole can be progressively lengthened.

The chemical can generally be any chemical with activity and concentration sufficient to dissolve rock materials found in the region suspected or known to contain oil, natural gas, or other desirable natural products. The chemical can be an acidic chemical or a non-acidic chemical. The acid can generally be any acid sufficient to dissolve rock materials found in the region suspected or known to contain oil, natural gas, or other desirable natural products. A presently preferred acid is hydrochloric acid, due in part to its relatively low price. Other acids that can be used include acetic acid, formic acid, nitric acid, and hydrofluoric acid. The single acid or mixture of acids can be selected based upon the types of minerals present in the rock materials to be dissolved. For example, a mixture of hydrochloric acid and acetic acid can be selected, as could a mixture of hydrochloric acid and formic acid. For dissolving rock materials containing clays or quartz, hydrofluoric acid can be selected. The fluid can be an aqueous acid solution, or a pure acid solution, depending upon the acid selected. As used herein, acid concentrations are in percent w/w. The concentration of acid in the fluid can generally be any concentration, including 100% acid. Commercially available hydrochloric acid is about 36% acid in water, while nitric acid and acetic acid can be obtained as essentially 100% acids. High concentration acids could be used "neat", that is without prior dilution with water. Aqueous acid solutions are presently preferred to be less than about 30%. The acid concentration can be less than about 20%, less than about 10%, less than about 8%, less than about 6%, less than about 5%, less than about 4%, less than about 3%, less than about 2%, or less than about 1%. Selection of the exact percentage can be determined based upon the desired rate of penetration and the types and density of the rock formation to be drilled. Specific examples of acid percentages include about 30%, about 20%, about 10%, about 5%, about 4%, about 3%, and about 2% acid. An example of a non-acidic chemical is $Na_4EDTA$ (ethylenediaminetetraacetic acid, sodium salt). The chemical can also be an organic acid such as sulphamic acid.

The fluid containing the chemical can be pumped continuously or non-continuously. For example, the fluid containing the chemical could be pumped in "pulses" rather than continuously. A specific example could include pumping a fluid lacking the chemical into the pipe, and the fluid containing the chemical could be pulsed into the pumping stream at various time and duration intervals.

The fluid can further comprise a corrosion inhibitor. The corrosion inhibitor preferably inhibits corrosion of the nozzle and/or pipe by the aqueous acid solution. Generally any corrosion inhibitor can be used. Examples of corrosion inhibitors include the CRONOX corrosion control products from Baker Petrolite. The concentration of corrosion inhibitors is generally any concentration which is effective at protecting the nozzle and/or pipe from acid damage. For example, effective concentrations of corrosion inhibitors include more than about 0 gallons per 1000 gallons to about 10 gallons per 1000 gallons. It is preferred that the corrosion inhibitor concentration is such that corrosion is limited to no more than about 0.02 $lbm/ft^2$ over a 12 hour exposure time.

The pressure at the nozzle can generally be any pressure effective to provide an acceptable rate of progression. The pressure can be high pressure or low pressure. Presently preferred pressures are at least about 2,000 psi, at least about 2,500 psi, at least about 3,000 psi, at least about 3,500 psi, at least about 4,000 psi, at least about 4,500 psi, at least about 5,000 psi, at least about 5,500 psi, at least about 6,000 psi, at least about 6,500 psi, at least about 7,000 psi, at least about 7,500 psi, at least about 8,000 psi, at least about 8,500 psi, at least about 9,000 psi, at least about 9,500 psi, or at least about 10,000 psi.

The flow rate of fluid through the pipe can generally be any flow rate effective to provide an acceptable rate of progression. Presently preferred flow rate ranges are about 0.1 bpm to about 20 bpm, about 0.1 bpm to about 10 bpm, about 0.1 bpm to about 5 bpm, and about 1 bpm to about 2 bpm. Specific examples of flow rates include about 0.1 bpm, about 0.5 bpm, about 1 bpm, about 2 bpm, about 3 bpm, about 4 bpm, about 5 bpm, about 6 bpm, about 7 bpm, about 8 bpm, about 9 bpm, and about 10 bpm.

The pipe used in the methods can generally be any type of pipe, for example, coiled tubing pipe or jointed pipe. Presently preferred is the use of coiled tubing (CT) pipe. The dimensions of the pipe can vary considerably, and can be modified to vary the system pressure, flow rate, and size of wellbore produced. The outer diameter can generally be any diameter acceptable for commercial use. For example, the outer diameter can be about 0.5 inch to about 5.5 inches. Specific examples of outer diameters include about 0.5 inch, about 1 inch, about 1.5 inches, about 2 inches, about 2.5 inches, about 3 inches, about 3.5 inches, about 4 inches, about 4.5 inches, about 5 inches, and about 5.5 inches. The inner diameter can generally be any diameter acceptable for commercial use. For example, the inner diameter can be about 0.45 inch to about 5.45 inches. Specific examples of inner diameters include about 0.45 inch, about 0.95 inch, about 1.45 inches, about 1.95 inches, about 2.45 inches, about 2.95 inches, about 3.45 inches, about 3.95 inches, about 4.45 inches, about 4.95 inches, and about 5.45 inches. The length of the pipe can generally be any length acceptable for commercial use. For example, the length can be up to about 30,000 feet. Specific examples of lengths include about 5,000 feet, about 10,000 feet, about 15,000 feet, about 20,000 feet, about 25,000 feet, and about 30,000 feet. A specific example of a pipe dimensions is about 1.25 inch to about 2.875 inches outer diameter, about 1 inch to 2.5 inches inner diameter, and about 300 feet to about 20,000 feet in length. The pipe itself can be a coiled tubing pipe or a jointed pipe. Generally any commercially acceptable material can be used in the pipe manufacture. Presently preferred materials include carbon steel, stainless steel, and composite materials.

The methods can further comprise returning the fluid to the surface after contact with the reservoir formation constituent. Once at the surface, oil and/or gas can be separated from the fluid using standard commercial methods. The separated fluid can then be treated and disposed using standard commercial methods.

The nozzle can generally be any type of nozzle. The nozzle can generally be any shape. While nozzles are commonly circular in shape, this is not required. Alternative shapes include annular, elliptical, triangles, squares, cloverleaf, "figure-8", and irregular shapes. The nozzle can be attached at the end of the pipe directly, or can be attached to a rotary bit tool, or attached to a jetting tool capable of high velocity cutting. The nozzle hole diameter can generally be any size, and will affect the pressure of the fluid exiting the nozzle. Examples of nozzle diameters include about 0.040 inch to about 0.5 inch, or about 0.040 inch to about 0.375 inch. Specific examples include about 0.040 inch, about 0.1 inch, about 0.2 inch, about 0.3 inch, and about 0.35 inch.

The nozzle can be connected to a variety of tools. For example, the nozzle can be connected to a bottom hole assembly, an orientating tool, or a navigating tool. The nozzle can be steered from the surface. This steering can be in one, two, or three dimensions. The nozzle can be contained in a rotary bit tool, or in a jetting tool capable of high velocity cutting.

Figure 6:
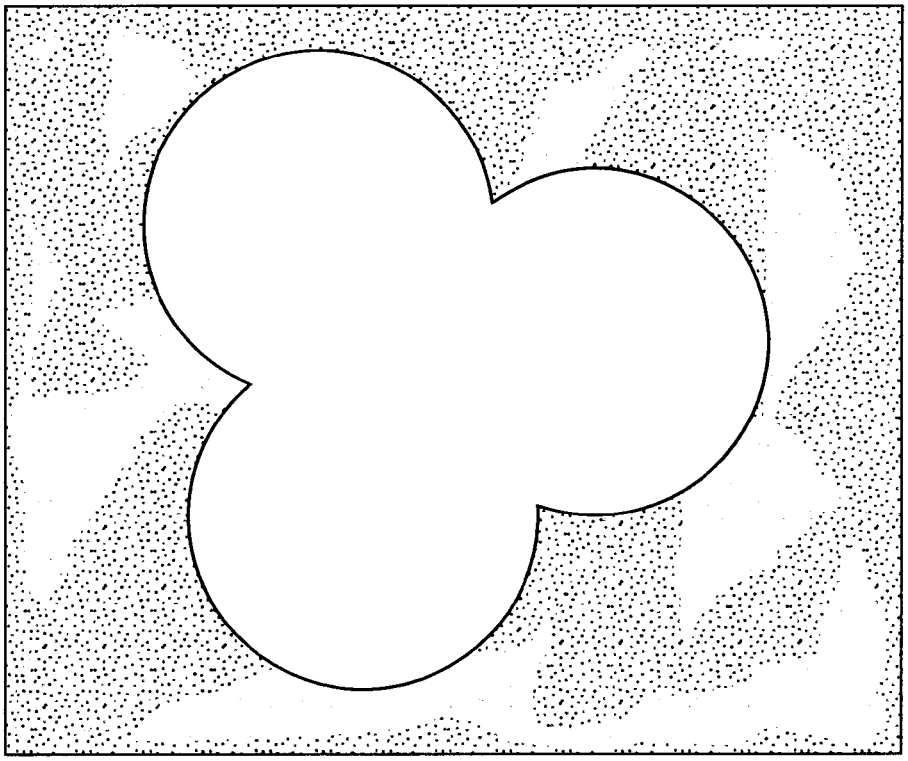

The produced borehole can generally be any shape and size. For example, the borehole can be straight, curved, deviated, vertical, horizontal, at a positive angle relative to the horizontal (i.e. sloped upwards), or at a negative angle relative to the horizontal (i.e. sloped downwards). The produced borehole can be a combination of these shapes, e.g. having multiple regions of different shapes and/or angles. The borehole can be a single hole, or can comprise a lateral junction of one or more side lateral boreholes. The borehole can follow a straight or non-straight plane at which a higher solubility rock meets a lower solubility rock (i.e. the borehole follows the profile of the lower solubility rock). While boreholes are commonly round in shape (i.e. round cross sectional shape), this is not required. Non-round shapes include triangular, oval, rectangular, square, cloverleaf (see FIG. 6), "figure-8", and elliptical shapes.

Chemically enhanced drilling can be used in conjunction with conventional drilling methods such as rotary mechanical drilling or percussion drilling.

An additional embodiment of the invention is directed towards devices useful for performing chemically enhanced drilling. Such an apparatus can be used in performing the above described methods.

A presently preferred apparatus comprises a container for holding a fluid comprising a chemical that dissolves a downhole formation constituent; a fluid pump connected to the container; and a pipe placed in a downhole formation, the pipe having a first end connected to the fluid pump, and a second end connected to at least one nozzle.

The container can hold the fluid comprising the chemical in a pre-mixed condition, or can have a mixing device to prepare the fluid comprising the chemical on an as-needed basis. The container can hold any of the fluids described in the above methods, such as an aqueous acidic solution, or an aqueous hydrochloric acid solution. The fluid pump can pump fluid at any of the pressures and flow rates described in the above methods. The pump can pump the fluid containing the chemical in a continuous or non-continuous fashion. As discussed above in relation to the inventive methods, the fluid containing the chemical can be "pulsed" into the pipe by the fluid pump.

The pipe can be any of the shapes, lengths, diameters, and materials described in the above methods. The pipe can comprise a continuous reeled tubing (coiled tubing) pipe and/or a jointed pipe.

The nozzle can be any of the shapes, sizes, and numbers described in the above methods. The nozzle can comprise orifices oriented in forward and lateral directions. The nozzle can be attached to a rotary bit tool, to a jetting tool capable of high velocity cutting., to a bottom hole assembly, to an orientating tool, to a navigating tool, or to multiple of these tools.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

EXAMPLES

Example 1: Evaluation of Target Rock Solubilities

Four rock samples were selected for analysis. The samples were predominantly calcite, and their exact percent compositions are listed below in Table 1, where ND=not detectable.

TABLE 1

| Mineral | Sample 1 | Sample 2 | Sample 3 | Sample 4 |
|---|---|---|---|---|
| Quartz ($SiO_2$) | trace | 1 | trace | trace |
| Calcite ($CaCO_3$) | 95 | 98 | 92 | 99 |
| Pyrite ($FeS_2$) | trace | ND | trace | ND |
| Chlorite | ND | trace | ND | ND |
| Mixed-layer Illite15/Smectite85 | 4 | trace | 7 | trace |

The acid solubility of the four samples was determined using 15% hydrochloric acid. The solubilities were 97.1%, 96.6%, 96.1%, and 97.5% by weight of Samples 1, 2, 3, and 4, respectively.

Example 2: Initial Laboratory Testing

Initial evaluations varied acid strengths between 0% and 15%, flow rates between 0.25 bpm and 2 bpm, and pressures from 0 psi to 4,000 psi. Laboratory tests were performed at room temperature and standard atmospheric pressure. The acidic liquids were applied to carbonate rock surfaces in a laboratory setting with the nozzles described below.

Various nozzles were evaluated. Testing was performed initially using an open ended pipe with a 2 inch external diameter, and an internal diameter of 1.75 inches. At a flow rate of 1.5 bpm, this affords a jet velocity of 11 ft/s. Next, a Roto-Jet® nozzle, a proprietary product of BJ Services, was used (Roto-Jet is a registered trademark of BJ Services). This tool is a rotating twin nozzle assembly designed to jet scale out of tubulars. The two nozzles are directed down at 45° relative to the central axis. The tool has an outer diameter of 2.125 inches, and was tested between 200 ft/s and 700 ft/s. Next, a nozzle design using a swirl inducer and an internal conical nozzle was used. The design had an outer diameter of 3.5 inches, and did not have a jet velocity associated with it, instead relying on the relatively slow moving film covering the internal surface of the conical shape. Finally, a nozzle design was used having a bull nose form covered with many individual nozzles. The jet velocity across each nozzle was very small due to the large number of nozzles.

All of the experiments created depressions in the rock surface. The use of higher acid concentrations formed more cylindrical depressions, but also formed valleys as the liquid ran off of the rock surface.

Example 3: Drilling with High Pressure Water

Laboratory experiments using a single jetting nozzle having a 0.275 inch diameter in the center of a 3.5 inch diameter body produced a jet velocity of 340 ft/sec at 1.5 bpm. Water directed at carbonate rock through this nozzle drilled a 15 inch hole into the rock. Using dilute hydrochloric acid, the nozzle could drill through the entire rock sample (about 3 feet).

The diameter of the drilled hole was fairly small, about 1.5 to 2 inches with water, and between 2 and 4 inches with acid, depending on the duration of the test and the concentration of the acid used.

Example 4: Alternative Nozzle Designs

A high-pressure nozzle containing several jetting nozzles was constructed. The first design was 3.5 inches in diameter, fitted with four 0.125 inch diameter nozzles. One nozzle was in the center, and the other three were evenly spaced around the outside. Use of this design created holes in the rock, but the hole was "clover leaf" shaped, and still not sufficiently large to allow entry of the jetting assembly.

A nozzle was designed to efficiently create round holes in the rock. A 3.5 inch diameter assembly was created having five 0.115 inch diameter nozzles in a circle between the center of the assembly and the outer perimeter. The use of this nozzle created clean circular holes in the rock. Penetration rates of about 25 ft/hour were achieved. Typical pumping conditions were 2 bpm at 4,000 psi with 7% acid, although good results were also observed with use of 5% acid.

A larger 5.625 inch nozzle was constructed using the same design principle, having ten nozzles. Use of this design created a round hole as quickly as the smaller design.

The following Table shows several round nose nozzle designs shown to be effective in laboratory tests at over 2,000 psi.

TABLE 2

| Nozzle number | Outside diameter | Number of nozzles | Nozzle diameter |
|---|---|---|---|
| 1 | 3.5 | 1 | 0.275 inch |
| 2 | 3.5 | 4 | 0.125 inch |
| 3 | 3.5 | 5 | 0.115 inch |
| 4 | 5.625 | 10 | 0.078 inch |

Rates of penetration of at least 20 ft/hr can be achieved at 5% acid, 2 bpm flow rate, and 4,000 psi pressure in a laboratory setting.

Example 5: Applicability of Laboratory Results to Down Hole Applications

Pump pressures were calculated based upon use of a 1.5 inch by 0.109 inch wall coiled tubing, assuming a true vertical depth of 10,000 feet with 11,000 feet of coiled tubing in the well.

TABLE 3

| | |
|---|---|
| Bottom hole pressure (including pressure to inject 2 bpm acid) | 800 psi |
| Nozzle pressure (based on the use of high efficiency nozzles) | 2,600 psi |
| Friction pressure through 11,000 feet of coiled tubing | 4,300 psi |
| Hydrostatic pressure of 5% HCl | −4,300 psi |
| Pressure at gooseneck | 3,400 psi |
| Friction pressure through 2,000 feet of coiled tubing at surface | 1,100 psi |
| Pump pressure | 4,500 psi |

Nozzle efficiencies were not optimized to reduce pressure loss in the laboratory experiments. Use of high efficiency nozzles would be preferable for down hole use. The pressures calculated in the previous table are reasonable for using a 1.5 inch coiled tube.

Example 6: Efficiency of Chemically Enhanced Drilling

The efficiencies of the laboratory experiments were reasonable, but much of the acid exited the hole by overflow, and had insufficient contact time with the rock surface to enlarge the hole. In a down hole application, this runoff would not occur, and the higher temperatures would likely enhance the chemical reaction with the rock material.

In the laboratory, 2 bpm of 5% HCl produced a 4 inch hole at a rate of about 20 ft/hr. This equates to 6 bbl per foot of hole, with an efficiency of about 10%. The higher down hole temperatures may significantly increase this efficiency. Even at a modest 50% efficiency, the rate of penetration would be 100–150 ft/hr, using 800 bbls of 5% acid. Any acid that did not actively participate in enlarging the hole would be effective at stimulating the well, resulting in increased production.

Example 7: Protection of Steel Tubulars

At the high down hole temperatures, it is preferable to protect metal surfaces in the coiled tubing. Corrosion inhibitors can be used to reduce or eliminate corrosive effects of the acid. Use of low concentration acid such as below 5% acid would also reduce or minimize corrosive effects.

Example 8: Chemically Enhanced Drilling in Sandstone Formations

Sandstone formations are typically formed by a framework of sand grains (50–95%) cemented in place by mixtures of overgrowth quartz, clays, and carbonates (5–50%). In rocks that are predominantly cemented with carbonate minerals, drilling using hydrochloric acid could accelerate the drilling process by substantially weakening the rock matrix. This drilling could be performed in conjunction with conventional mechanical drilling, percussion drilling, or other acceptable method. The acid could be gelled using materials such as xanthan or polyethyleneoxide.

In the case of sandstones where clays and quartz are the predominant cementitious phases, the use of hydrofluoric acid would be appropriate. The hydrofluoric acid system would be preferably calcium tolerant and contain materials designed to prevent or inhibit the formation of secondary precipitates.

All of the compositions and/or methods and/or processes and/or apparatus disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and/or apparatus and/or processes and in the steps or in the sequence of steps of the methods described herein without departing from the concept, spirit and scope of the invention. More specifically, it will be apparent that certain agents which are chemically related may be substituted for the agents described herein while the same or similar results would be achieved. All such similar substitutes and modifications apparent to those skilled in the art are deemed to be within the spirit, scope and concept of the invention.

What is claimed is:

1. A method for drilling a borehole, the method comprising:

pumping a fluid through a pipe located in a downhole formation;

jetting the fluid through at least one nozzle connected to the end of the pipe; and dissolving the formation constituent near the nozzle to produce a borehole; wherein the fluid comprises a chemical that dissolves the formation constituent, and wherein the fluid is an aqueous hydrochloric acid and acetic acid solution or an aqueous hydrochloric acid and formic acid solution.

2. The method of claim 1, wherein the downhole formation is a suspected or known oil or gas reservoir.

3. The method of claim 1, further comprising progressively moving the nozzle into the borehole.

4. The method of claim 1, wherein the fluid is an aqueous hydrochloric acid and acetic acid solution.

5. The method of claim 1, wherein the fluid is an aqueous hydrochloric acid and formic acid solution.

6. The method of claim 1, wherein the fluid comprises up to about 5% acid.

7. The method of claim 1, wherein the fluid comprises up to about 3% acid.

8. The method of claim 1, wherein the fluid further comprises a corrosion inhibitor.

9. The method of claim 1, wherein the pressure at the nozzle is at least about 2,000 psi.

10. The method of claim 1, wherein the flow rate through the pipe is about 0.1 bpm to about 20 bpm.

11. The method of claim 1, wherein the pipe is a continuous reeled tubing (coiled tubing) pipe.

12. The method of claim 1, wherein the pipe is a jointed pipe.

13. The method of claim 1, wherein the outer diameter of the pipe is about 0.5 inch to about 5.5 inches.

14. The method of claim 1, wherein, the inner diameter of the pipe is about 0.45 inch to about 5.45 inches.

15. The method of claim 1, further comprising returning the fluid to the surface.

16. The method of claim 1, further comprising returning the fluid to the surface, and separating oil and/or gas from the fluid.

17. The method of claim 1, wherein the nozzle is attached to a rotary bit tool.

18. The method of claim 1, wherein the nozzle is attached to a jetting tool capable of high velocity cutting.

19. The method of claim 1, wherein the produced borehole is a round borehole.

20. The method of claim 1, wherein the produced borehole is a straight borehole.

21. The method of claim 1, wherein the produced borehole is a curved borehole.

22. The method of claim 1, wherein the produced borehole is a vertical borehole.

23. The method of claim 1, wherein the produced borehole is a deviated borehole.

24. The method of claim 1, wherein the produced borehole is at a positive angle relative to horizontal.

25. The method of claim 1, wherein the produced borehole is at a negative angle relative to horizontal.

26. The method of claim 1, wherein the produced borehole is about horizontal.

27. The method of claim 1, wherein the produced borehole comprises a lateral junction of one or more side lateral boreholes.

28. The method of claim 1, wherein the produced borehole follows a plane at which a higher solubility rock meets a lower solubility rock.

29. The method of claim 1, further comprising producing the borehole with rotary drilling.

30. The method of claim 1, further comprising producing the borehole with percussion drilling.

31. The method of claim 1, wherein the nozzle is attached to a bottom hole assembly.

32. The method of claim 1, wherein the nozzle is attached to an orientating tool.

33. The method of claim 1, wherein the nozzle is attached to a navigating tool.

34. The method of claim 1, further comprising steering the nozzle from the surface.

35. The method of claim 1, further comprising steering the nozzle from the surface in a two dimensional direction.

36. The method of claim 1, further comprising steering the nozzle from the surface in a three dimensional direction.

* * * * *